United States Patent [19]

Orthey, Jr.

[11] 4,248,206

[45] Feb. 3, 1981

[54] AUXILIARY DRAFT DEVICE FOR FIREPLACE

[76] Inventor: George F. Orthey, Jr., R.D. #1, Newport, Pa. 17074

[21] Appl. No.: 92,480

[22] Filed: Nov. 8, 1979

[51] Int. Cl.[3] ..... F24B 1/18

[52] U.S. Cl. ..... 126/143; 126/288; 126/140

[58] Field of Search ..... 126/120, 121, 139, 143, 126/288, 285 R; 237/51; 98/36, 59

[56] References Cited

U.S. PATENT DOCUMENTS

| | | | |
|---|---|---|---|
| 2,130,851 | 9/1938 | Baron | 126/288 |
| 3,298,195 | 1/1967 | Raskhodoff | 98/36 |
| 4,061,127 | 12/1977 | Fisher | 126/120 |
| 4,095,581 | 6/1980 | Billmeyer et al. | 126/143 |
| 4,106,475 | 8/1978 | Mayes | 126/121 |
| 4,108,144 | 8/1978 | Wilhoite | 98/36 |
| 4,137,895 | 2/1979 | Bittinger | 126/120 |
| 4,195,618 | 4/1980 | Kellogg | 126/121 |

FOREIGN PATENT DOCUMENTS

| | | | |
|---|---|---|---|
| 417858 | 10/1934 | United Kingdom | 126/120 |

*Primary Examiner*—James C. Yeung
*Attorney, Agent, or Firm*—C. Hercus Just

[57] ABSTRACT

An auxiliary draft device for a fireplace to produce a curtain of air discharged upwardly in front of the fireplace opening and comprising a horizontal sheet metal air-distributing shell having fixed walls and decreasing in width from one end to the other to effect a substantially even discharge of air across said fireplace opening by air discharge openings in the top wall of the shell, said shell being supported solely by a floor adjacent the hearth of the fireplace and which, at the wider end thereof, is connected to an extension shell of sheet metal which is a plenum chamber at one side of the fireplace which communicates with a horizontal conduit extending along one side of the fireplace, transversely to said chamber and extending through the exterior wall of room in which the fireplace is located and communicating with outdoor air, inlet of which is controlled by an adjustable exterior damper operable by manual adjustment of mechanism extending from said damper to the interior of said room.

5 Claims, 10 Drawing Figures

AUXILIARY DRAFT DEVICE FOR FIREPLACE

BACKGROUND OF THE INVENTION

The auxiliary draft device for a fireplace comprising the present invention is directed at improving the efficiency of consumption of fuel in the fireplace and also to reduce or prevent the removal of warm air in the room in which a fireplace is located which, under normal circumstances with conventional fireplaces, is required to provide some, if not most of the air required to cause the fuel of the fireplace to burn.

A fireplace of conventional design requires an inflow of air which, in turn, when heated, is lost up the chimney. Further, such air exhaust from a room causes a negative pressure inside the room and any adjoining rooms, thus causing cold air to flow in at any possible opening in the building in which the room is located. Obviously, such ingress of cold air causes unnecessary fuel consumption, particularly since it acts adversely to the conventional home heating system and requires a greater amount of heat from said system to counteract the cold air drawn in by such circumstances.

In modern homes which are highly effectively insulated, as well as in efficiently heated homes, a conventional fireplace is becoming prohibitively wasteful in terms of fuel consumption due to wasted warm air being consumed from the room by the fuel in the fireplace and resulting in drafts across floor areas. As a result of this, particularly in view of the present high cost of fuel, the use, if not the installation, of fireplaces is being reduced, although there is the possibility of greater use of the same in areas of abundant wood being available and the cost thereof being appropriately less than that of fuel oil and the like.

In such normal or conventional fireplaces, the air flow for igniting the fuel is through the front opening of the fireplace, then through the combustion chamber and up through the rear area of the combustion chamber, past the damper and into the smoke chamber and then up the flue. For greatest efficiency, such path of air flow is critical and any system that disrupts the even flow of such air results in inefficient burning of fuel and, under certain circumstances, causes the discharge of smoke into the surrounding room areas.

As described hereinafter, the present invention involves the use of an air curtain supplied across the front face of the fireplace opening. The principle of air curtains which effect separation of two chambers or spaces used at the entrance of stores, refrigerator rooms, and the like to prevent air flow between such spaces is well-known and proven. Providing such an air flow up across the front of a fireplace opening similarly tends to effectively separate and prevent any appreciable amount of the warm room air from the fireplace chamber while providing air to achieve combustion of the fuel in the fireplace and thereby effectively reduce air consumption from the surrounding room area.

The invention also includes the provision of an opening through a room wall adjacent the fireplace in order to permit the introduction of outside air to the fireplace. In this regard, it also is known that any opening through an outside wall of a building can be a source of unwanted cold air leaking into the building unless such an opening is closed at the outside wall.

Further, it also is quite well established that combustion within a fireplace chamber that is closed, for example, by glass doors across the face of the chamber frequently causes smoking of the glass with soot and tar due to the rolling of the smoke against the glass when the air flow is restricted. Further, it also is known that the burning of a fireplace of conventional configuration with glass doors across the front thereof, when closed, may cause overheating of the glass front, especially if the air intake vents which usually are provided in the lower portion of glass door assemblies and units are not open. But, when they are open, there obviously is a continual consumption of interior warm air by the fireplace obtained from the room and other vicinities near the fireplace from which such air is obtained.

It also is known to provide combustion air for fireplaces from sources outside of the room, such as exterior air, and also provide means for regulating the flow of such air to the fireplace. By way of example, prior U.S. Pat. No. 4,106,475, to Mayes, dated Aug. 15, 1978, and U.S. Pat. No. 4,137,895 to Bittinger, dated Feb. 6, 1979, respectively show the introduction of outside air directly to the lower part of the combustion chamber, and directed radially and inward toward the lower part of said combustion chamber. However, systems that direct auxiliary air, such as outside air, either at the back of the combustion chamber or immediately beneath the same, cause an intense blowing effect at the base of the fire which not only frequently causes more rapid consumption of fuel than otherwise, but also effects a disruption of the natural flame and fire patterns which are pleasing in appearance and thus, detract from the desirability and pleasure of a normal fireplace fire. These difficulties are obviated by the present invention, details of which are as follows:

SUMMARY OF THE INVENTION

It is one of the principal objects of the present invention to provide an auxiliary draft device and system for installation at the front face of a fireplace opening for purposes of drawing air from the outside of the building in which the fireplace is located and direct the same as a vertical curtain of air across the front face of the fireplace, thereby tending to minimize the drawing of air for combustion purposes from the room and adjacent area in which the fireplace is located, without impairing the normal aesthetic appearance of the fire or increasing the rate of consumption thereof due to the fact that the curtain of air from the outside atmosphere is entirely supplemental and acts as a substitute for air which, in normal fireplace installations, is drawn from the immediate room vicinity.

It is another object of the invention ancillary to the foregoing object to provide in the auxiliary draft device an air-distributing shell formed of sheet metal of rigid nature which is supported horizontally and solely upon a floor surface directly in front of and extending across the front opening of the fireplace adjacent the hearth, said shell having a top wall in which a plurality of openings are provided through which air obtained from outdoors is directed vertically upward to form said aforementioned air curtain which is substantially of uniform density entirely across said fireplace opening.

A further object of the invention is to provide said aforementioned air-distributing shell, in plan view, with a width which decreases from one end toward the other and said draft device also including at said one end an extension shell which operates as a plenum chamber, said plenum chamber extending transversely to said one end of said air-distributing shell, along one side of the fireplace and also communicating with horizontal conduit means leading from said plenum chamber to the outside atmosphere by means of an appropriate opening through the wall of the building in which the fireplace is located.

Still another object of the invention is to provide on the outer end of said horizontal conduit, an adjustable exterior damper having actuating means extending from the damper and having a manually-operable handle or the like readily accessible at the front of the fireplace for controlling the extent of opening of the damper to permit the inlet of outside air to the fireplace.

Another object of the invention ancillary to the immediately foregoing object is to arrange the air outlet openings in the top wall of the air-distributing shell in such manner that they are arranged for suitable spacing from the larger end of said shell toward the smaller end for purposes of providing a vertically moving air curtain of essentially uniform density across the entire front face of the fireplace opening.

A still further object of the invention is to arrange the components of the auxiliary draft device and system in the form of individual, connectable components which are readily assembled for installation in conjunction with a fireplace and said components being adapted to be merchandised in kit form, the detachability particularly of the air-distributing shell from the extension shell which serves as a plenum chamber permitting relatively easy removability of the air-distributing shell from the plenum chamber, especially for purposes of facilitating the removal of ashes from the fireplace, it also being a feature of the auxiliary draft device that the air-distributing shell is forward of the location of fuel in the combustion chamber of the fireplace, whereby at least in normal use, the ashes of the fuel will not drop upon said air-distributing shell and the relatively forward position of said air-distributing shell adjacent the front face of the fireplace minimizing the possibility of damage to said shell by the heat generated in the combustion chamber.

Still another object of the invention is to provide an auxiliary supply of outdoor combustion air to the fireplace, particularly a fireplace in which glass doors are used across the front face of the fireplace, the air-distributing shell of said draft device being immediately adjacent the inner surface of said glass doors so as to distribute the vertical air curtain upwardly adjacent the inner surface of the glass doors and thus, prevent the same from becoming excessively hot and also minimizing the accumulation of smoke and tar thereon.

Details of the foregoing objects and of the invention are set forth in the following specification and illustrated in the accompanying drawings comprising a part thereof.

DETAILED DESCRIPTION OF THE PREFERRED EMBODIMENTS

Figure 1:
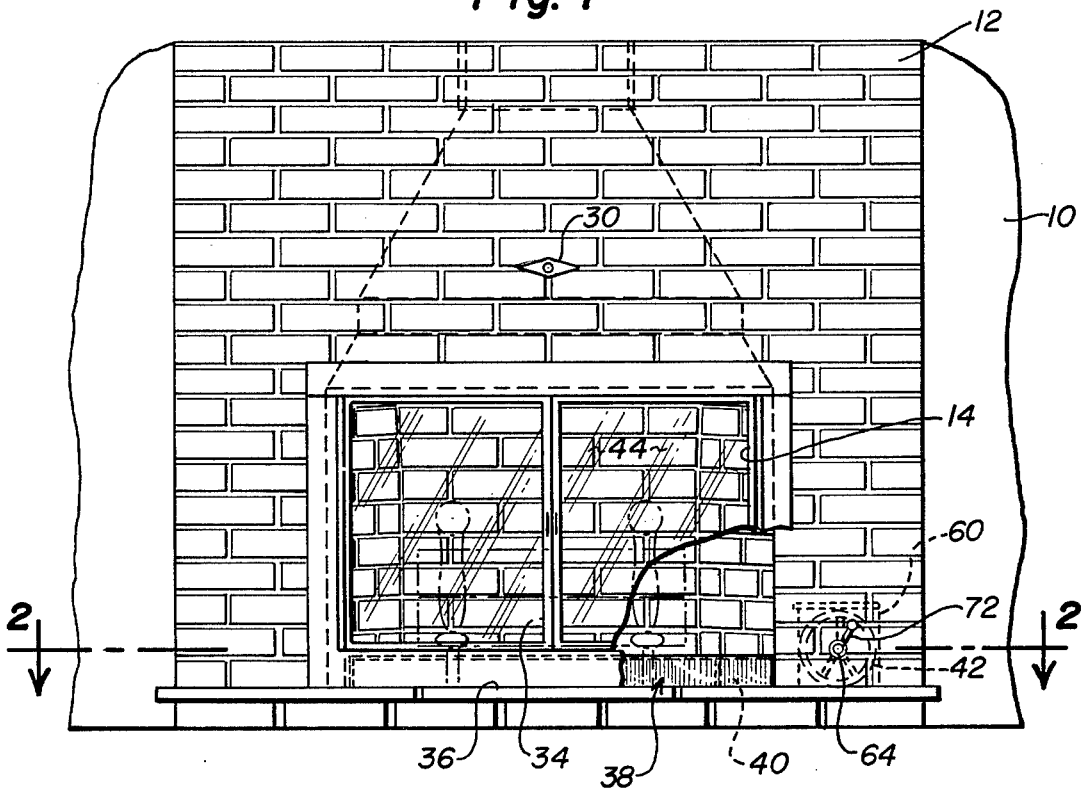
FIG. 1 is a front elevation of a conventional fireplace adjacent one wall of a room shown fragmentarily, said fireplace being the type having glass doors across the front face thereof, part of one door being broken away to show details of the invention.
Figure 2:
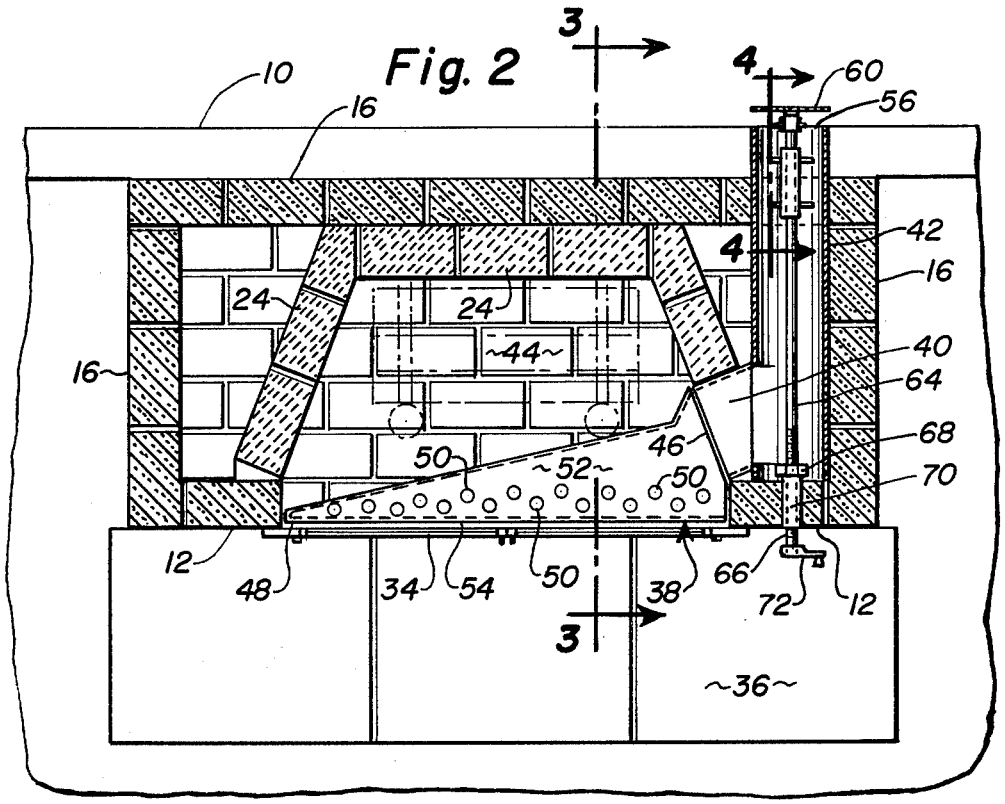
FIG. 2 is a horizontal sectional view of the fireplace installation shown in FIG. 1, as seen on the line 2—2 thereof, and illustrating in horizontal section a portion of the horizontal conduit means leading to the exterior of the building in which the fireplace is located.
Figure 3:
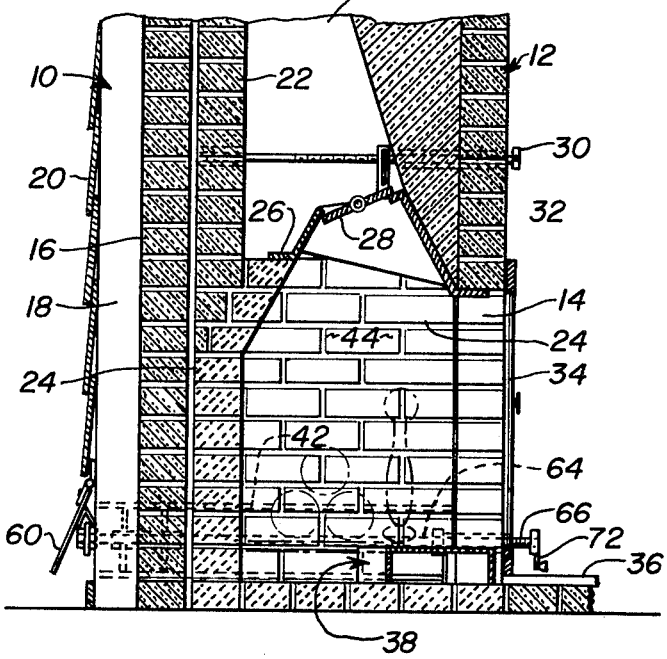
FIG. 3 is a fragmentary vertical sectional view of the fireplace shown in FIGS. 1 and 2, as seen on the line 3—3 of FIG. 2.

Referring particularly to FIGS. 1–3, an exemplary wall 10, such as the outside wall of a building, is illustrated for purposes of affording a background for the exemplary fireplace 12, which is illustrated as being constructed of brick masonry, and having a fireplace opening 14 in the front face of the fireplace 12. In the illustration, according to FIGS. 2 and 3, it will be seen that the wall 10, which is considered to be an outside wall, consists of an exemplary brick sub-wall 16 against which studs 18, see FIG. 3, are disposed and to which exemplary exterior sheathing 20 is applied.

The actual fireplace 12 has a chimney wall 22, see FIG. 3, of conventional brick which extends above a substantially U-shaped firebrick wall 24, suitably shaped to provide a smoke shelf 26, shown in FIG. 3, which is in cooperation with an adjustable damper 28, controlled by a manual actuator 30, the exemplary front face of the fireplace 12 also having a vertical brick wall 32. In the exemplary illustration shown in FIGS. 1–3, the fireplace opening 14 also is covered by a pair of glass doors 34, especially for purposes of showing the adaptability of the present invention to fireplaces to which glass doors have been applied, or otherwise.

Referring to FIGS. 1–3, the fireplace 12 also is provided with a conventional hearth 36 which usually is substantially at floor level or slightly thereabove and, especially for purposes of this invention, is considered to be the equivalent of a floor.

The auxiliary draft device of the present invention comprises essentially three related components which respectively are the sheet metal air-distributing shell 38, the extension shell or plenum chamber 40, and the horizontal inlet conduit 42. Additional details related to these three components are described in detail hereinafter. Said three components also are readily detachably connectable and, in particular, the air-distributing shell 38 is detachable from the extension shell 40, especially for purposes of replacing the same in the event such replacement ever is necessary, and more particularly, to render the distributing shell 38 removable from in front of the combustion cavity 44 in which, for example, the fireplace fuel, such as logs, and and irons are mounted as shown in phantom, particularly in FIGS. 1–3. From FIG. 2, in particular, it will be seen that the air-distributing shell 38 is supported upon the floor of the combustion cavity 44 which is preferably in the same plane as the hearth 36 and/or the floor of the room in which the fireplace is installed. Such detachability of the distributing shell 38 facilitates the removal of ashes from the floor of the combustion cavity 44.

Figure 6:
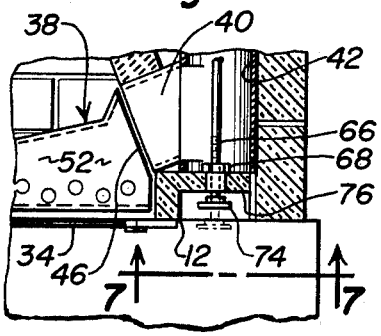
FIG. 6 is a fragmentary horizontal sectional view of a portion of the device shown in the lower right-hand corner of FIG. 2 and illustrating a slightly different embodiment of installation of manually-operable regulating means for the outdoor shutter shown in FIGS. 3 and 4.
Figure 8:
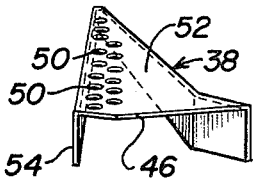
FIG. 8 is a perspective view of the air-distributing shell shown in plan view in FIG. 2 adjacent the front face of the fireplace illustrated therein.

Also, from FIGS. 2, 6 and 8, it will be seen that the distributing shell 38, which preferably is made from a suitable gage of sheet metal capable of resistance to any extensive damage from the heat of the combustion of the fuel in the fireplace cavity 44, is wider at the inlet end 46 than at the opposite end 48, which is closed. The purpose of such shape is to render the distribution of air substantially uniform between the opposite ends of the shell 38. Such air distribution occurs from a plurality of holes 50 which are formed in the top wall 52 of the shell 38 which preferably is horizontal. Particularly from FIG. 8, it will be seen that the shell 38 also is substantially rectangular in cross-section and, by way of example, without restriction, a suitable vertical dimension of the shell is approximately four inches. Further, to facilitate the uniform distribution of air between opposite ends of the shell 38, it will be seen that the holes 50 are a little more closely spaced adjacent the inlet end 46 of the shell 38 than at the opposite end thereof for suitable arrangement of the same in order that the holes 50 are arranged as closely as feasible to the front wall 54 of the shell 38. As a result of this, outside or outdoor air which enters through the inlet end 56 of inlet conduit 42, as viewed in FIG. 2, passes along the conduit to the plenum chamber 40 and from there, it enters the distributing shell 38 through the inlet end 46 thereof and exits substantially vertically through the holes 50 in such manner that a cold air curtain of substantially uniform density rises vertically from the shell 38, completely across the front face of the combustion cavity 44 of the fireplace, where it becomes available for combustion of the fuel and additionally serves the important function of minimizing the consumption of warm air from the room in which the fireplace is located, thereby at least greatly preventing the consumption of such warm air by the fireplace and thereby not burdening the conventional heating means of the room where the fireplace is installed.

Figure 4:
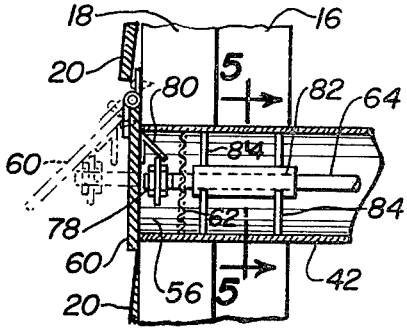
FIG. 4 is a fragmentary vertical sectional view of a portion of the air-inlet end of conduit means of the device located in the lower left-hand corner of FIG. 3.
Figure 5:
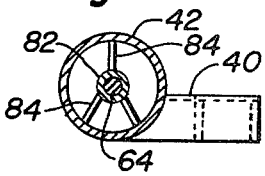
FIG. 5 is a vertical sectional view of the conduit means shown in FIG. 4, as seen on the line 4—4 thereof.

The passage of such cool or cold outdoor air as aforesaid is induced primarily by the normal draft effected by the combustion of fuel in the fireplace cavity 44 which rises upwardly through the damper opening, when the damper 28 is open, and thence upwardly through the flue 58, as readily can be visualized from FIG. 3. Further, particularly in the event the fireplace includes glass doors 34, for example, especially if said doors are closed, the outdoor air furnished by the aforementioned means, especially the air-distributing means 38, is highly effective to supply the needed combustion air for the fuel, and by virtue of the upwardly rising curtain of such air immediately adjacent the inner surfaces of the doors 38, the possibility of such doors accumulating smoke stain and tar, as occurs in many types of glass doors associated with conventional fireplaces, is substantially eliminated. Another essential feature of the present invention comprises the control means by which the inlet of outside air enters the horizontal inlet conduit 42. Several embodiments of operating means for said control means are included and are described below. Both of them are associated with a shutter member 60 which is attached to the exterior wall face of the house, such as sheathing 20 as shown in FIGS. 3 and 4. The shutter 60 operates in the nature of a damper and preferably is pivoted at the upper edge thereof so that, when open to any desired degree, it will serve as a shield for the inlet of inclement weather. To prevent the ingress of undesired items of animal or insect nature, the inlet end 56 of the conduit 42 also preferably includes a screen barrier 62, shown in exemplary manner in FIG. 4.

Figure 7:
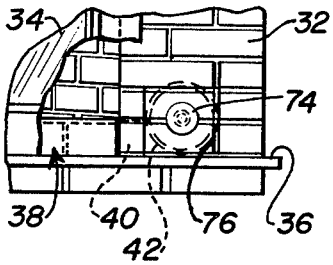
FIG. 7 is a fragmentary vertical front view of a portion of the details shown in FIG. 6, as seen on the line 7—7 thereof.

One of the several embodiments of actuating means for the shutter member 60 is illustrated in FIGS. 2–7 and comprises a rotatable rod 64, which extends centrally within inlet conduit 42 for the entire length thereof as best shown in FIG. 2, and one end, designated as the inner end 66, is threaded, as shown in FIGS. 2, 3 and 6, for engagement with a fixed nut 68 positioned on the inlet end of a sleeve 70, which, as shown in FIGS. 2 and 6, extends through the brick facing 12, for example, of the fireplace for rotatable actuation by one of several types of manually operable elements, such as the crank 72 shown in FIGS. 2 and 3, or the rotatable knob 74, shown in FIGS. 6 and 7. The knob 74, for example, preferably is located in a recess 76, such as shown in FIGS. 6 and 7 to render the same less obtrusive than the crank 72, for example. Rotation of either the crank 72 or knob 74 relative to the fixed nut 68 moves the rod or shaft 64 axially for purposes of actuating the outer end 78 of rod 64 which engages any suitable means on shutter member 60, such as an angular flange 80 for purposes of controlling the closed position of shutter member 60, as shown in full lines in FIG. 4 or a desired degree of opening of the shutter, as shown in phantom in FIG. 4. Operative positioning of the outer end 78 of rotatable rod 64 within the inlet conduit 42 is achieved by a fixed bearing sleeve 82, see FIGS. 4 and 5, which is supported by appropriate spider members 84.

To prevent the inlet of outdoor air to the inlet conduit 42 when the shutter member 60 is closed, as shown in full lines in FIG. 4, the inner surface thereof may be suitably provided with appropriate gasket-type sealing means around the perimeter or across the entire inner face thereof for purposes of abutting the terminal end of the inlet conduit 42.

Figure 9:
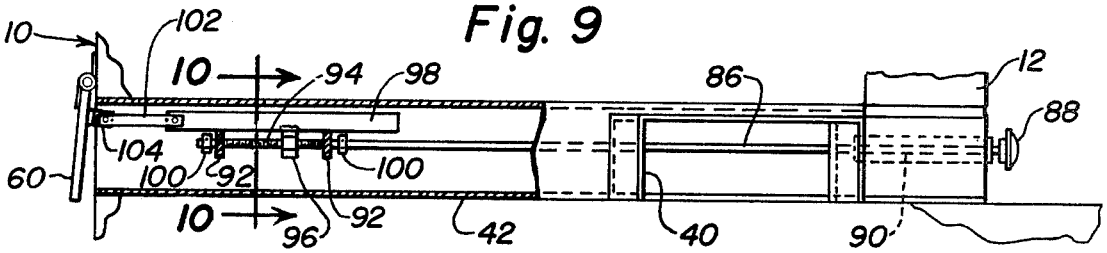
FIG. 9 is a side view, partly in vertical section, of another embodiment of the air inlet conduit of the device and illustrating a further embodiment of shutter-adjusting means from that shown in FIGS. 2, 4, 6 and 7.
Figure 10:
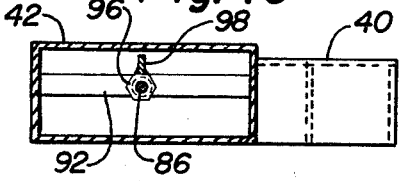
FIG. 10 is a vertical sectional view, as seen on the line 10—10 of FIG. 9.

The additional embodiment of actuating means for the shutter member 60 is illustrated in FIGS. 9 and 10, in which the conduit 42 may be circular, if desired, or particularly as shown in FIG. 10, it may be rectangular in cross-section. As in the preceding embodiment, the shutter member 60 is pivotally connected at its upper end to the outer wall of a house or building and a rotatable rod 86 extends for the full length of the inlet conduit 42. The inner end has an actuating knob 88 connected thereto, said inner end of the rod also being supported in a bearing sleeve 90 mounted in the front brickwork face of the fireplace 12. The outer end of the rod 86 extends through suitable openings in a pair of longitudinally spaced, transverse supporting bars 92, which are fixed within the interior of the conduit 42. Said outer end of the rod 86 is provided with threads 94 which match a threaded nut 96, which is fixed to a longitudinal bar 98, which slides along the upper surfaces of the supporting bars 92 as the rod 86 is rotated relative to the nut 96. Longitudinal movement of the rod 86 is prevented by means of a pair of nuts or other abutment means 100 which are fixed to the rod 86 respectively adjacent the outermost surfaces of the supporting bars 92. A link 102 is pivotally connected respectively at its opposite ends to the outer end of bar 98 and a lug or clevis 104 is fixed to the inner surface of the shutter member 60 in spaced relation to the pivot on the upper end of the shutter member 60, as clearly shown in FIG. 9.

From this description, it will be seen that, as the knob 88 is rotated in opposite directions, it respectively will move the shutter member 60 between fully closed and a desired open position for purposes of effecting the regulation of ingress of outdoor air to the conduit 42 and thence to the air-distributing shell 38.

From the illustration shown in the drawings, it can be visualized that utilization of the auxiliary draft device comprising the invention is best undertaken when building or installing a new fireplace, particularly for purposes of incorporating the horizontal inlet conduit 42 within the masonry of one sidewall, for example, of the fireplace 12 and also for installing the extension shell and plenum chamber 40 within one side firebrick wall 24 of the fireplace. However, when it is desired to install such a device in existing fireplaces, it may be necessary to make limited revisions or changes in the actual shaped and construction of the air-distributing shell 38, extension shell and plenum chamber 40, and horizontal inlet conduit 42, for purposes of minimizing the formation of appropriate openings in the masonry of the fireplace and the firebrick wall thereof which should be adequate to accommodate the aforementioned elements, particularly to dispose the air-distributing shell 38 across the front face of the combustion chamber 44 of the fireplace at the floor level thereof. Especially if no glass doors are desired or actually are mounted upon the existing fireplace, the distributing shell 38 may be disposed somewhat forwardly of the position thereof shown in FIG. 2, for example, and actually rest upon the hearth 36, whereby especially the installation of the air-distributing member 38 will require no modification of the floor of the combustion cavity 44 or the hearth 36, as is necessary in certain prior art auxiliary air-distributing mechanism and in particular, the aforementioned U.S. Pat. Nos. 4,106,475 and 4,137,895.

From the foregoing, it will be seen that the present invention provides a relatively simple and durable auxiliary draft device for a fireplace which can be installed either in new or existing fireplaces with a minimum of adaptation being required, and in particular, the air distribution provided by said device develops a curtain of air entirely across the front face of the combustion chamber which may be either the open type or one that is provided with glass doors, such curtain of auxiliary outdoor air minimizing, if not preventing, any appreciable amount of warm air of the adjacent room entering the combustion zone of the fireplace, such curtain of air also, when employed with a fireplace having glass doors thereon, minimizing, if not eliminating, the occurrence of smoke and tar deposits upon the inner surface of the glass doors, the overall objective of the device being to also render the combustion of fuel economical and in a manner to prevent the occurrence of smoke or swirling of the fireplace flame as frequently occurs in auxiliary air installations in which air is introduced either directly beneath the fuel or immediately in front thereof and directed more or less laterally toward the front of the combustion zone where smoking, as well as unduly rapid consumption of fuel is the result. The device comprising the invention also may be employed with fireplaces having other forms of auxiliary heat forming and distribution, such as certain shell-like constructions sold commercially under the tradename "HEATALOR" and otherwise. Further, it is to be noted that no auxiliary power means are required to operate the device of the present invention, such as auxiliary blowers operated by electric motors and the like, which is common to a number of existing auxiliary air devices for fireplaces, some of which are associated with means to introduce outside air, as well as those consuming warm air from within the room in which the fireplace is installed.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. For use with a conventional fireplace having a hearth, an auxiliary draft device adapted to discharge a substantially even curtain of outdoor air directed upwardly in front of the fireplace opening and comprising in combination, an elongated sheet metal air-distributing shell composed of fixed sidewalls of uniform limited height and parallel top and bottom walls of similar shape adapted to be supported horizontally and solely by resting upon a hearth directly in front of and extending across the front opening of said fireplace adjacent the hearth, air discharge opening means in said top wall extending along substantially the entire length of said shell, an extension projecting horizontally outward from one end of said shell and comprising a plenum chamber communicating with the interior of said shell, said air-distributing shell gradually decreasing in width from said one end of said shell adjacent said plenum chamber toward the other end and is closed at said other end and said air-discharge opening means being arranged to provide an air curtain of substantially even volume across the entire front of a fireplace, horizontal conduit means connected at one end to said plenum chamber and extending laterally therefrom, said conduit means being adapted to extend along one end of said fireplace and through the exterior wall of a room in which said fireplace is located to communicate with outdoor air, an adjustable exterior damper adjacent the outer end of said conduit means, and adjusting means connected at one end to said damper and the other end being adjacent said plenum chamber and adapted to be manually operated to adjust said damper to regulate the quantity of outdoor air to be delivered to said shell for discharge to effect said curtain of outdoor air.

2. The draft device according to claim 1 in which said air-discharge means comprises a series of holes in said top wall of said air-distributing shell, said holes being of substantially uniform diameter but suitably spaced and arranged in a pattern to provide said aforementioned substantially even volume in said curtain of air.

3. The draft device according to claim 1 in which said damper comprises a shutter member hinged at the upper edge thereof relative the exterior wall of said room, and said adjusting means comprising a threaded horizontal rotatable rod extending along said conduit and one end thereof being rotatably coupled to the inner surface of said shutter, and mating threaded means fixedly supported relative to said conduit and engaging said threaded rotatable rod, whereby rotation of said rod in opposite directions respectively moves said shutter between fully closed and desired open positions.

4. The draft device according to claim 3 further including manually engageable means on the end of said rod opposite the coupled end and positioned for accessability adjacent one side of said fireplace.

5. The draft device according to claim 1 in which the components thereof set forth in said claim are connectable operatively to each other but initially are separate and adapted to be packaged in kit form for assembly and installation with new or existing ireplaces.

* * * * *